US007228881B1

(12) United States Patent
Smith

(10) Patent No.: US 7,228,881 B1
(45) Date of Patent: Jun. 12, 2007

(54) WOOD PROCESSOR

(76) Inventor: Richard H. Smith, 237 State Highway 320, Norwich, NY (US) 13815

( * ) Notice: Subject to any disclaimer, the term of this patent is extended or adjusted under 35 U.S.C. 154(b) by 0 days.

(21) Appl. No.: 11/377,579

(22) Filed: Mar. 17, 2006

(51) Int. Cl.
*B27L 7/00* (2006.01)

(52) U.S. Cl. ..... 144/193.1; 144/3.1

(58) Field of Classification Search ..... 144/192, 144/193.1, 193.2, 195.1, 195.6, 195.7, 195.8, 144/1.1, 2.1, 3.1
See application file for complete search history.

(56) References Cited

U.S. PATENT DOCUMENTS

| | | | | |
|---|---|---|---|---|
| 3,780,779 | A | 12/1973 | Guy | |
| 4,081,008 | A | 3/1978 | Dilling | |
| 4,266,585 | A | 5/1981 | Denzer | |
| 4,269,242 | A * | 5/1981 | Smith et al. | 144/192 |
| 4,273,171 | A * | 6/1981 | Spaulding, Sr. | 144/195.1 |
| 4,285,374 | A | 8/1981 | Klingel | |
| 4,478,263 | A * | 10/1984 | Johnston | 144/4.6 |
| 4,503,894 | A | 3/1985 | Gratkowski | |
| 4,782,870 | A | 11/1988 | Duerr | |
| 4,829,865 | A | 5/1989 | Nunnery et al. | |
| 4,830,070 | A * | 5/1989 | Nunnery et al. | 144/195.1 |
| 4,834,154 | A | 5/1989 | Nunnery et al. | |
| 4,869,303 | A | 9/1989 | Nunnery et al. | |
| RE33,233 | E * | 6/1990 | Freeman | 144/4.6 |
| 4,945,960 | A | 8/1990 | McCauley | |
| 5,441,090 | A | 8/1995 | Hill et al. | |
| 5,651,404 | A | 7/1997 | Kraemer et al. | |
| 5,803,141 | A | 9/1998 | Patterson | |
| 5,894,873 | A * | 4/1999 | Weeks | 144/4.6 |
| 6,732,774 | B1 | 5/2004 | Seckel | |
| 6,779,570 | B2 | 8/2004 | Tardif | |

* cited by examiner

*Primary Examiner*—Shelley Self
(74) *Attorney, Agent, or Firm*—Mark Levy & Associates, PLLC; Lawrence R. Fraley

(57) ABSTRACT

A wood processor including a motor vehicle having a bed structure, a clamping device on the bed structure for clamping a wood log and positioning it in a first processing position, a power saw for cutting predetermined length members from the wood log, and a splitting device for splitting the wood members into a specified number of pieces.

16 Claims, 8 Drawing Sheets

WOOD PROCESSOR

TECHNICAL FIELD

The invention relates to apparatus for processing wood products and particularly to those designed for cutting and splitting wood logs and the like. Even more particularly, the invention relates to such apparatus which are mounted on a motor vehicle such as a truck.

BACKGROUND OF THE INVENTION

Perhaps the most common apparatus for processing wood logs include those designed for cutting or splitting the wood. Among the most well known of these for cutting wood include the conventional chain-driven saw (known usually as a "chain saw") which can be hand-held and operated by a single person with suitable skills. Wood splitters are also known, some examples being mounted on a trailer or other frame-like structure and often pneumatically driven. Such splitters are also usually operated by one person, with another person preferably used to load wood onto the splitter. While these apparatus are well known and in wide use in many parts of this country, these are limited in the amount of work that can be performed on a daily basis. As a result, most are only used for relatively small jobs, e.g., to satisfy the operator/owner's own needs, e.g., for home heating such as in a woodstove.

To hopefully provide greater processing capabilities, various vehicle-mounted and trailer-mounted wood processing apparatus have been developed, the latter, trailer-mounted, being the most widely known. Typically, these apparatus are limited in their functioning capabilities, e.g., these usually either cut or split the wood but not both. Some have loading, discharge or other added capabilities, but still lack the capability to process wood logs and the like on a large scale without requiring utilization of additional equipment. Examples of wood processors are described in the following patents.

In U.S. Pat. No. 3,780,779, there is described a hand portable attachment for splitting logs which is attachable to a tractor or similar equipment to work in conjunction with the tractor's "power piston." This attachment includes a frame which is detachably attached to the tractor.

In U.S. Pat. No. 4,081,008, there is described an upright free-standing log splitter operated by a vertical ram energized from a source such as a tractor to which the log splitter may be secured, or a trailer. The log splitter may be placed on a rear part of a truck or the like by means of parallel bars so that the splitter may be placed on the ground or raised for transportation. Wheels may be provided for the working platform or bed of the splitter so that it may be pulled, such as a trailer is pulled.

In U.S. Pat. No. 4,266,585, there is described a log splitter which can apparently be attached to a bumper of an automotive vehicle and which utilizes the power steering pump of the vehicle to operate a hydraulic cylinder of the log splitter to advance and retract a log-engaging ram head in relation to a stationary log splitting wedge near the far end of the device. The splitting wedge has a protective swinging guard biased to the active safety guarding position by retraction of the cylinder operated ram head and biased to an inactive or open position by a spring device.

In U.S. Pat. No. 4,285,374, there is described a mobile wood splitter in which a single steel wedge is mounted on one end of an I-beam base. A hydraulic cylinder is attached to the opposite end of the base and has its piston connected to a power ram which is slidably attached to the top surface of the I-beam base. A pair of removable legs are mounted to the bottom surface of the base and the entire wood splitter is mounted on an A-frame which is adapted for connection to the front end of any vehicle that is equipped to handle snow removal equipment.

In U.S. Pat. No. 4,503,894, there is described a wood splitting device for mounting on a vehicle, including a hydraulically operated log splitter. The wood splitter is capable of being pivoted from a horizontal position along one side of the vehicle to a vertical position at the rear of the vehicle or to any angular position there-between, and is operational in any of these positions. The pivoting movement of the log splitter is powered by a hydraulic cylinder which moves guide and support arms pivotally connected to the splitter for supporting the splitter on the vehicle. The cylinder and the log splitter may be connected to the same hydraulic system, driven by an engine through a hydraulic pump and reservoir.

In U.S. Pat. No. 4,782,870, there is described a portable wood splitter having a splitter frame adjustably mounted to a support frame. In one embodiment the support frame is wheel-supported and in another embodiment the support frame is mountable to a vehicle such as a tractor for transport. The splitter includes a splitter beam with a blade mounting slide plate powered to move toward and away from a platform at a lower beam end. The slide plate includes safety features to avoid finger injury. A double gib adjustment on the slide plate facilitates adjustment for wear and enables centering adjustments of the blade on the beam. The beam is mounted to the support frame by a clamp arrangement that will facilitate selective longitudinal adjustment of the beam relative to the frame. The beam is pivotal, on the first embodiment between a horizontal position overlying a towing tongue and an upright position. An adjustment feature enables re-positioning of the towing tongue from its horizontal operative position to an upright compact condition where an end of the tongue engages the ground surface to stabilize the unit.

In U.S. Pat. No. 4,829,865, there is described a wood processor for cutting a log into a series of shorter lengths and subsequently splitting the shorter lengths into individual pieces of firewood or the like. The processor includes a carriage for receiving the log. Clamps engage the log from both sides to secure it in the carriage which advances the log into contact with a plurality of parallel rotating saws. After the carriage is retracted a pusher rod moves the cut log pieces along an axis onto a plurality of cradle members, one cradle supporting each log section. The cradle members are tilted to dump the log sections alternately onto opposite sides of the axis of log movement. The logs dumped from the cradles are fed to a plurality of individual hydraulically operated log splitters.

In U.S. Pat. No. 4,830,070, there is described wood processor having similar capabilities as that described in U.S. Pat. No. 4,829,865, both patents being commonly assigned.

U.S. Pat. Nos. 4,834,154 and 4,869,303, also assigned to the same assignee as U.S. Pat. Nos. 4,830,070 and 4,829,865, also describe wood processing apparatus having similar capabilities as the apparatus in said patents.

In U.S. Pat. No. 4,945,960, there is described a double-action vertical wood splitter, intended to be mounted on a tractor or the like, which splits wood on each stroke of a hydraulic actuator. A removable double-edged blade is mounted on an elongated carriage which telescopically interacts with the frame resulting. A log-positioning cradle holds the wood being split in position on the splitter; additionally, it allows the operator to work from a position of safety in the event that the wood splits violently or attempts to kick out of the splitter. The blade coupling system allows the splitting blade to be removed for maintenance or replaced with another style blade, or it allows the splitter to be used as a hydraulic power unit which may be used with other attachments.

In U.S. Pat. No. 5,441,090, there is described a wood-gripping apparatus that may be rotatably mounted on a vehicle, comprising an articulated boom with a gripping head rotatably and pivotally mounted thereto. The head is provided with opposable jaws that apply pressure to a wood object being gripped. A saw may be pivotally mounted to the head. A drive coupling may be provided to provide a continuous rotary link between hydraulic lines on a boom. The coupling comprises a coupling body rotatably housed within a sheath with a groove between the coupling body and the sheath. The groove permits fluid to be transmitted from the body to the sheath while these are rotated relative to each other. The boom may be provided with a link joining two of the segments, provided with dual articulated cylinder mounts on opposing sides and capable of permitting approximately 360 degrees of rotation between the segments.

In U.S. Pat. No. 5,651,404, there is described a wood splitting apparatus which includes two wood splitting stages mounted on a trailer or truck bed. A first stage for splitting large diameter wood pieces is adapted to be transported in a substantially horizontal orientation to be pivoted to a vertical orientation for use. A horizontal second splitting stage is mounted horizontally. A double stage hydraulic system enables independent reciprocation of the two wood splitting stages independently of each other and is powered by a single motor for driving the hydraulic pump. Preferably a platen at the bottom of the vertical splitting assembly is located a distance from the pivot axis sufficient to engage a level ground surface and thereby to relieve a portion of the weight of the vehicle from a wheel thereof when in a vertical orientation.

In U.S. Pat. No. 5,803,141, there is described an apparatus mountable to a support vehicle for splitting and loading firewood. The apparatus includes a rigid connecting member and a wood splitter supported in a downward orientation by the connecting member. The connecting member includes a proximal component and a distal component, the proximal component mountable to the support vehicle and the distal component traversably mounted to the proximal component. The distal component includes traversing means for traversing the distal component relative to the proximal component. The wood splitter is rigidly mounted to the distal component, the wood splitter being traversable via the traversing means into a selectable position which is in alignment with the ends of a wood piece.

In U.S. Pat. No. 6,732,774, there is described a multi-purpose farm apparatus which comprises a trailer, a combination baler and wood splitter and a hydraulic system mounted thereon. The combination baler and log splitter apparatus includes a baling portion having a baling chamber and a first gib assembly comprising a pressure platen and is mounted for reciprocal movement within the baling chamber. The combination baler and log splitter apparatus further includes a log splitting portion having a second gib assembly comprising a splitting wedge and is mounted to the trailer for reciprocal movement. The first gib assembly and the second gib assembly are mechanically coupled to the hydraulic system for effecting reciprocating movement of the first gib assembly and the second gib assembly. The hydraulic system further comprises a hydraulic motor.

In U.S. Pat. No. 6,779,570, there is described a wood gathering and compaction vehicle which includes a vehicle frame movable over ground, a storage bin removably installed on the vehicle frame, with the storage bin having an inlet opening and an outlet opening. The vehicle further comprises a releasable bin attachment device for releasably attaching the storage bin to the vehicle frame, and a compactor fixedly installed on the vehicle frame, the compactor having an inner chamber, an opened inlet port for allowing wood to be inserted into the compactor inner chamber, an outlet port communicating with the storage bin inlet opening when the storage bin is installed on the vehicle frame, and a compaction device for allowing wood located in the compactor inner chamber to be forcibly moved from the compactor inner chamber into the storage bin through the compactor outlet port and the storage bin inlet opening.

While the apparatus described above are capable of performing desired wood processing functions, it is believed that these apparatus are not capable of doing so in a facile manner such as taught in the present invention. It is believed that a wood processing apparatus possessing the unique capabilities as taught herein would represent a significant advancement in the art.

OBJECTS AND SUMMARY OF THE INVENTION

It is, therefore, an object of this invention to enhance the wood processing art.

It is another object of this invention to provide a wood processor capable of performing various functions in a facile manner, and which utilizes a motor vehicle as part thereof.

It is another object of the invention to provide such a wood processor which can perform such functions using various, cooperatively working structures of relatively simple construction such that the processor can be manufactured and utilized in a relatively efficient manner, yet which is capable of processing relatively large loads of wood in less time than processors such as those described above.

According to one embodiment of the invention, there is provided a wood processor comprising a motor vehicle including a bed structure, a clamping device positioned on the motor vehicle for clamping a wood log and positioning it on the bed structure, a power saw positioned on the motor vehicle for cutting the wood log on the bed structure to produce a wood member having a predetermined length, and a splitting device positioned on the motor vehicle for splitting the wood member in at least two pieces such that the pieces can be removed from the motor vehicle.

BEST MODE FOR CARRYING OUT THE INVENTION

For a better understanding of the present invention, together with other and further objects, advantages and capabilities thereof, reference is made to the following disclosure and appended claims in connection with the above-described drawings. Like figure numbers will be used from FIG. to FIG. to identify like elements in these drawings.

By the term "motor vehicle" as used herein is meant a mechanically self-propelled vehicle (e.g., driven by a power train coupled to an engine such as an internal combustion or diesel engine) capable of circulating on the road, normally used for carrying goods, and operable by one or more human beings. Well known examples include trucks, such as those defined below. Motor vehicles as so defined are well known and further definition is not necessary.

Figure 1:
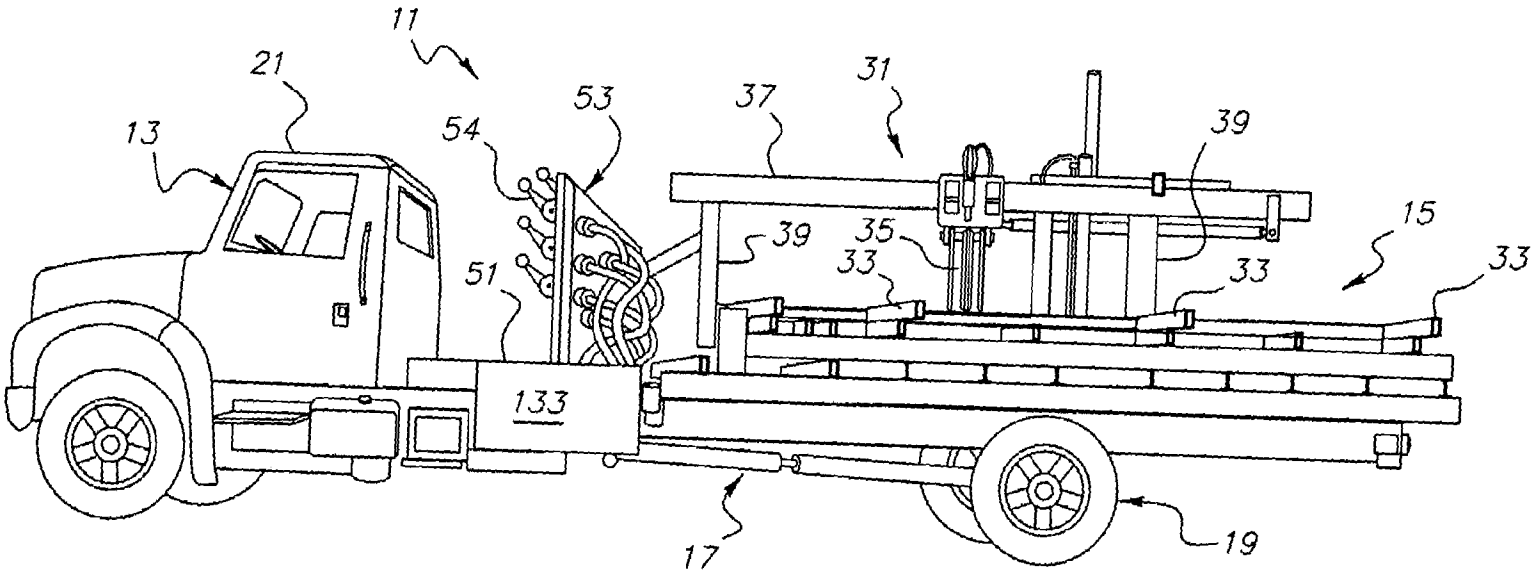
FIG. 1 is a side view, in elevation, showing a wood processor according to one embodiment of the invention.

In FIG. 1, there is shown a wood processing apparatus 11 according to one embodiment of the invention. Apparatus 11 includes a motor vehicle, here shown as a truck 13, having a "bed" structure 15. By the term "bed" structure as used herein is meant to include a bare frame structure provided on most conventional trucks before additional structures (e.g., a solid floor, mixer, etc.) are added thereto, as well as the conventional flatbeds found on many such trucks today. Other variations are well within the scope of those skilled in the art. In a preferred embodiment of the invention, many of the components defined herein (e.g., the clamping, splitting and cutting devices, defined in greater detail below) are secured (e.g., bolted) directly onto the exposed bare frame structure of a truck. Several examples of such trucks are known, including those sold by International Truck and Engine Corporation (e.g., the International 4700 Series diesel truck), GMC (e.g., the GMC W-4500 Series gas engine (Chevrolet) truck) and Ford Motor Company (e.g., the Ford F-750 Super Duty diesel truck, with an eighteen foot bed). Truck 13 includes a drive train 17 to the rear wheels 19 if of the conventional, only rear wheel drive type, but may also be of the 4-wheel drive version in which the front wheels are also driven. As understood, such a truck also includes a conventional cab 21 in which the vehicle operator (not shown) sits when driving the truck from location to location. Further description of truck 13 is not believed necessary, it being understood that the invention is not limited solely to trucks of this type. Other types of motor vehicles may be used.

In the apparatus of FIG. 1, bed structure 15, being a bare frame, is approximately twenty-five feet long and only about three feet wide (the width of the longitudinal steel members extending from the cab 21 backward as shown. This is of course not limiting of the invention as longer or shorter beds are possible, as are beds of narrower or wider widths. The present bed dimensions are considered preferred for the various components to be located thereon and the relative spaced positioning thereof, as will be defined in greater detail herein-below.

Apparatus 11 further includes a clamping device 31 (see also FIG. 4) which is positioned on (bolted to) bed 15 and designed for clamping onto a wood log WL (FIG. 2) and positioning the log onto a pre-selected part of bed 15. In a preferred embodiment, the part of the bed designed to accept the clamped log is comprised of a plurality of parallel rails 33, also bolted (or welded) onto the longitudinal steel members defined above. These rails are preferably steel I-beams or the like and can readily accommodate logs which are extremely heavy, as well as those which are much lighter. As one of knowledge in the wood processing field is aware, log weight depends on the type of wood and the moisture content. High moisture content oak logs will weigh more than low moisture pine logs, for example. The apparatus of the invention is able to successfully process all types of wood having from low to high moisture contents.

Figure 2:
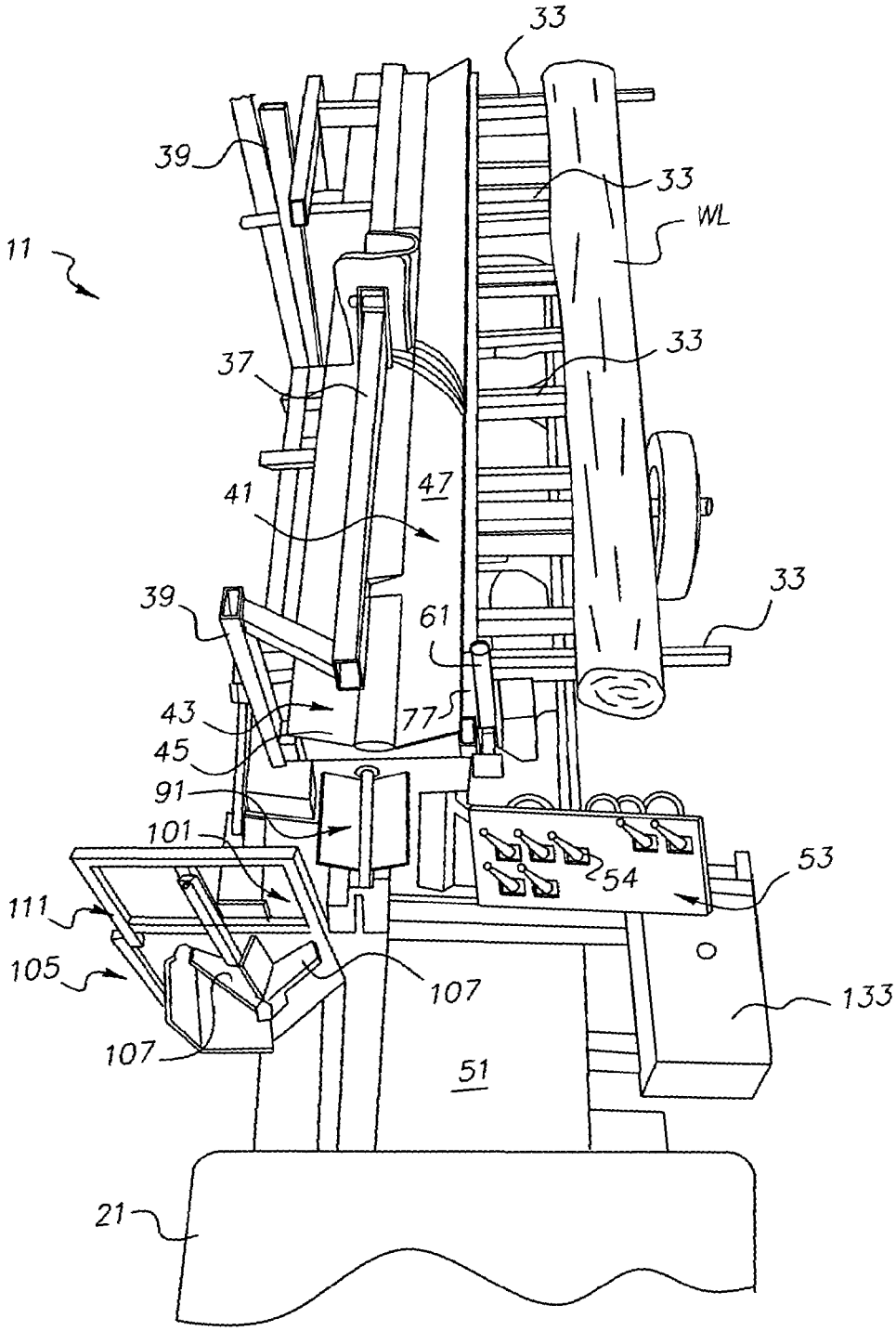
FIG. 2 is a partial top view of the wood processor of FIG. 1, showing a wood log loaded thereon.
Figure 4:
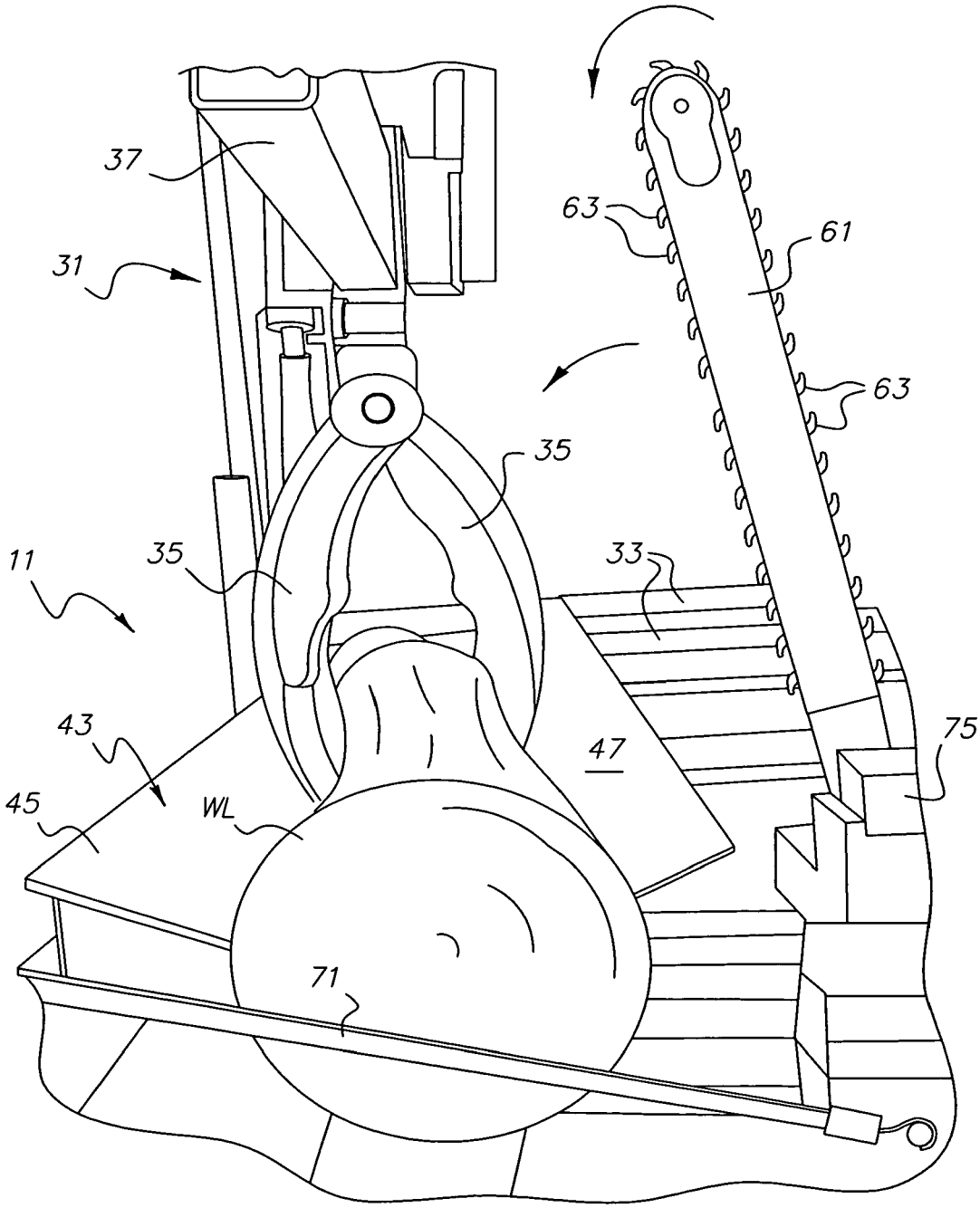
FIG. 4 is a partial end view showing a wood log positioned on the bed structure of the invention prior to cutting thereof.

Clamping device 31, as best seen in FIG. 4, includes at least two clamping jaws 35 which are hydraulically operated by the apparatus operator (described in greater detail below) and which move along a horizontal frame member 37 positioned on and supported by at least two upright struts 39, which are bolted or welded to the bare frame bed. The horizontal frame member (and struts) is preferably of steel and secured to the struts 39 by welding or bolts. The apparatus operator hydraulically activates the jaws 35 to clamp the log once it has been positioned on bed 15 and then move it into the desired final positioning for eventually cutting and subsequent splitting. It is thus understood that in the embodiment of FIG. 1 (and FIG. 4), clamping device 31 does not move to a location outside the bed confines to clamp a wood log. Instead, the log is placed on the bed (specifically rails 33) in the position shown in FIG. 2 and the clamping jaws then activated to grasp the log and move it into the initial processing position 41 (FIG. 2). This is not meant to limit the invention, however, as it is readily possible to modify the clamping device of this invention to enable it to extend well beyond the bed and even grasp a wood log (e.g., located on the ground) and bring it to the bed proper.

As seen in FIG. 2, the initial processing position 41 is atop a tapered base plate 43 having side panels 45 and 47. Panels 45 and 47 are preferably of steel and, as shown, of solid, plate-like form. Panels 45 and 47 are preferably welded to rails 33 and, being tapered, assist in positioning the heavy log held by jaws 35 as the jaws move the log (FIG. 4). In one example, base plate 43 is eighteen feet long, but may of course be much longer or even shorter, depending on operational requirements.

As mentioned, the apparatus operator activates device 31, preferably using hydraulics, from a work station (platform) 51 (FIGS. 1 and 2) which includes a valve operated panel 53 having a series of hydraulic valves 54 which, when opened and closed, operate various components of apparatus 11. Hydraulic activation is preferred due to the heavy workload requirements for the components, e.g., lifting long, high moisture logs. As understood, such hydraulic activation is used to both clamp the log and to also move the clamping device along the horizontal frame member 37. All of this and the other hydraulic operations performed herein are possible from the work station 51, using the common panel with all the needed hydraulic valves. In this manner, the operator is at a relatively safe, yet fully observable, position from which he/she can perform all of the necessary processing functions defined herein. The invention is thus able to be operated by a single person and does not require additional personnel, a unique and highly advantageous aspect of this invention. As mentioned, such operation is possible while the operator is in a relatively safe position, further enhancing the invention. For ease of illustration, panel 53 and the associated hoses are not shown in FIG. 3. It is also to be noted that some components are intentionally not shown from FIG. to FIG., again for ease of illustration and explanation.

Figure 5:
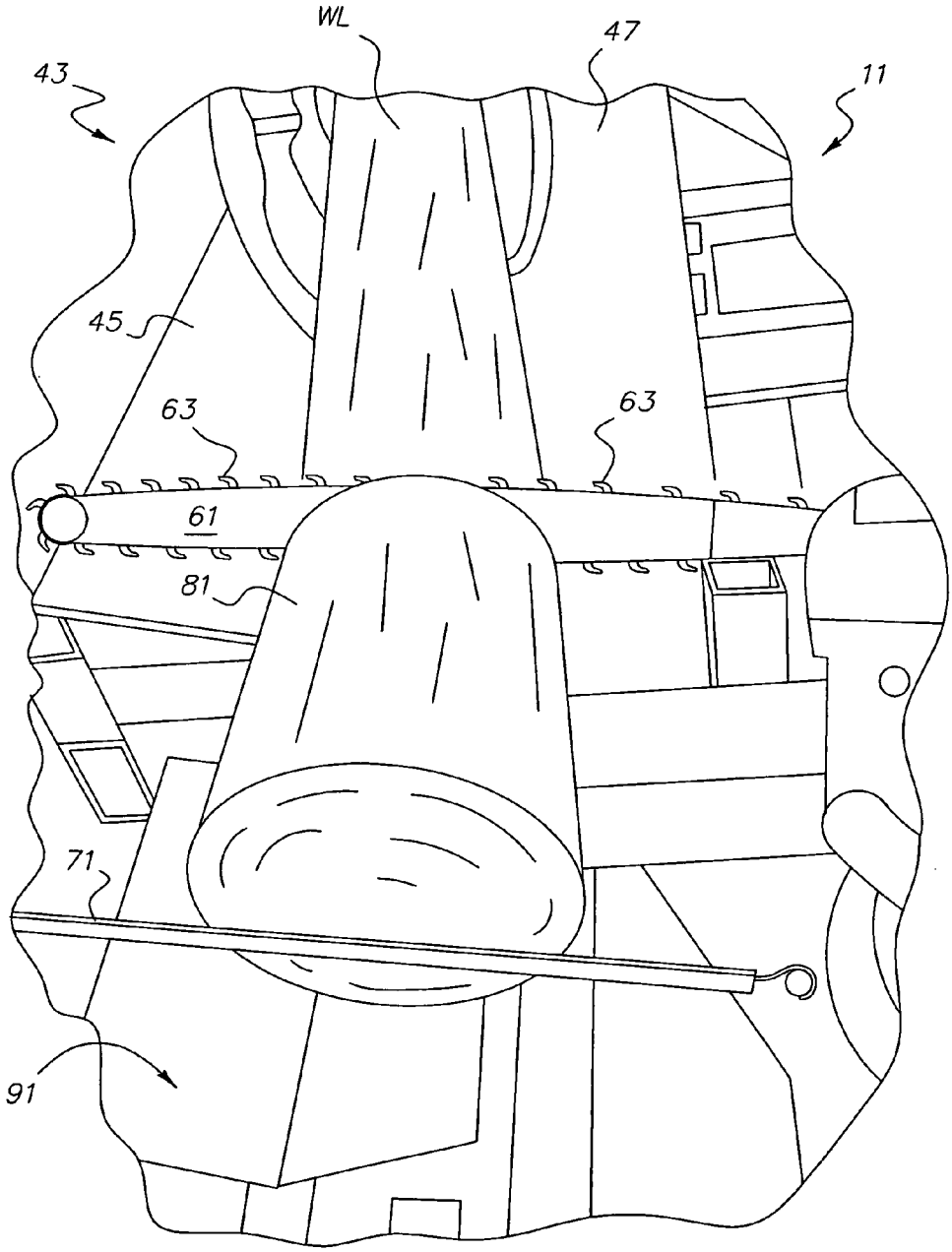
FIG. 5 is a partial end view similar to FIG. 4, showing the wood log being cut.

In FIGS. 2, 4 and 5, apparatus 11 is shown to further include a power saw 61, preferably similar to a conventional "chain saw", which is mounted on bed 15 and, in one embodiment, adapted for being positioned at various locations, depending on the cut length of the wood items being cut from wood log WL. See below for the preferred saw placement and desired length cutting arrangement. Saw 61 is seen to include a number of conventional (steel) cutting teeth 63 mounted on a steel chain which is driven over a pair of spaced pulleys as is conventionally known for many chain saws. The rotational movement of the saw 61 on bed 15 is also accomplished hydraulically, and activated by the apparatus operator when wood log WL is in its final location of the first processing position. This is seen in FIG. 5, and occurs when the wood log is moved forward (toward the cab 21) by the clamping device 31 until the leading edge of the wood log encounters a stop strap 71. Such engagement indicates to the operator that the desired forward position for the log has been reached and he/she then stops the clamping device from further movement. The saw 61 is then activated, whereupon it will rotate onto the log from its initial position of FIG. 4 and commence cutting the log as shown in FIG. 5. Such cutting occurs until the log is fully cut and the operator then ceases operation of the saw, from his/her work stand 51, using an appropriate hydraulic valve. In one embodiment, saw 61 may have a blade length of twenty-five inches and driven by a gasoline motor, much like conventional chain saws.

It was mentioned that saw 61 may be mounted such that is can be moved, depending on the desired cut length from log WL. For example, the saw's body 75 (FIG. 4) which may include the gasoline motor for driving the chain, may be secured to a lateral brace (FIG. 2) at a location such that wood items approximately eighteen inches are cut, this being the distance from the stop strap 71 to the plane occupied by the saw's cutting teeth. Greater and shorter distances are of course possible, examples being at twenty-four, thirty and thirty-six inches, all depending on the desires of the wood purchaser for the final split sections (see below). That is, if different length members are desired, it is only necessary to uncouple the saw body portion from its one location and move it to another location at which such different cuts may occur. Alternatively, and most preferably, it is possible to alter the cut length by maintaining the saw in its shown position and simply moving the stop strap 71 incrementally one way or the other, from the position shown in the drawings. This is accomplished by providing pairs of holes within the bed structure at designated locations and placing the ends (i.e., each having a hook as shown in FIG. 4) of the stop strap within the desired pair of said holes. In this manner, the wood log will be moved to a different location until stop strap engagement, at which time the operator will witness the wood log-strap engagement and proceed further, e.g., commence the cutting operation. This latter procedure is preferred to eliminate the need for continuous removal of the saw itself when different cut lengths are called for. The invention is thus readily able to accommodate a variety of desired cut lengths, thereby indicating another advantageous aspect of this invention.

Figure 6:
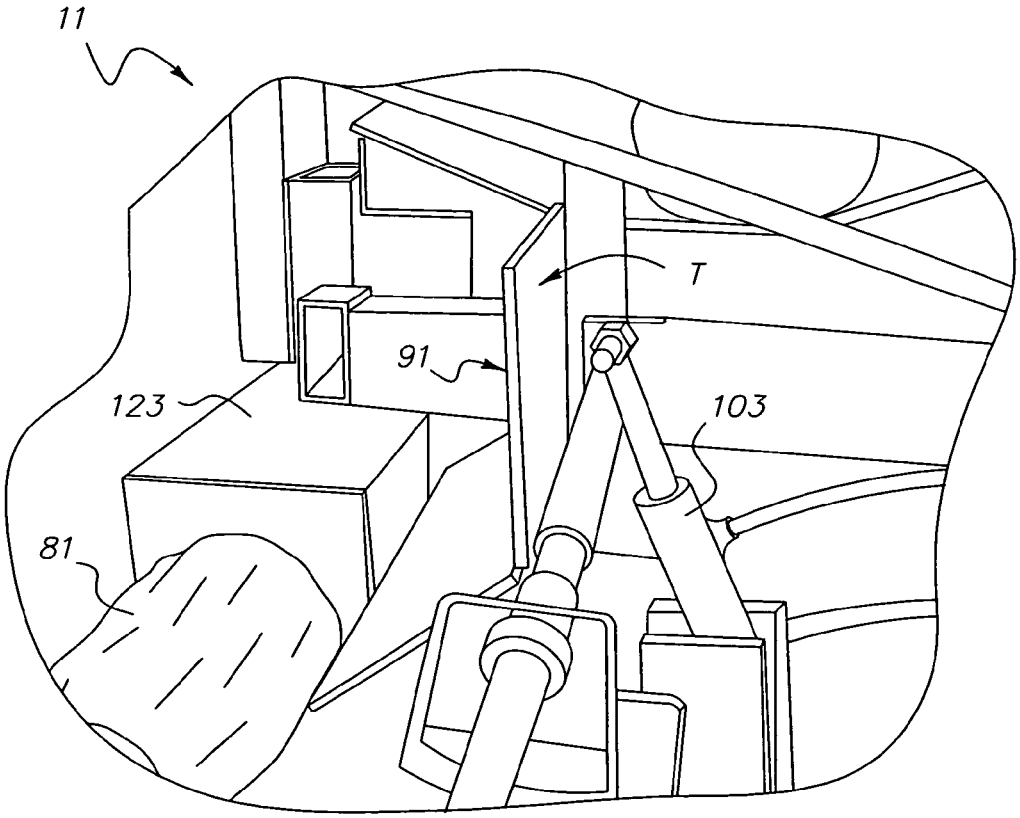
FIG. 6 is a partial end view, similar to FIG. 4, showing the wood member cut from the wood log in FIG. 5 dropping onto a receiving tray.

In FIG. 5, the desired length (e.g., eighteen inches) wood member 81 is shown being cut from wood log WL. Significantly, apparatus 11 includes a pivotal catch tray 91 (see also FIGS. 2, 3, 5, 6 and 8) located slightly below the upper tapered base plate 43 and adapted for catching the cut (severed) member 81 and moving in a counterclockwise manner (when viewed as seen in FIG. 6) to deposit the member onto a lower receiving tray 101 (see especially FIG. 3). The catch tray is also preferably operated hydraulically, by the operator from his/her workstation 51. Trays 91 and 101 are thus seen to be positioned at strategic locations relative to bed 15 so as to firstly accept the cut member and then to move it to a second processing position (on tray 101) where subsequent processing occurs. In one embodiment, receiving tray 101 is located approximately twenty-six inches below the plane of bed 15. FIG. 6 clearly illustrates the hydraulically actuated cylinder 103 which is activated to cause the tray to rotate in the direction indicated (T).

Figure 3:
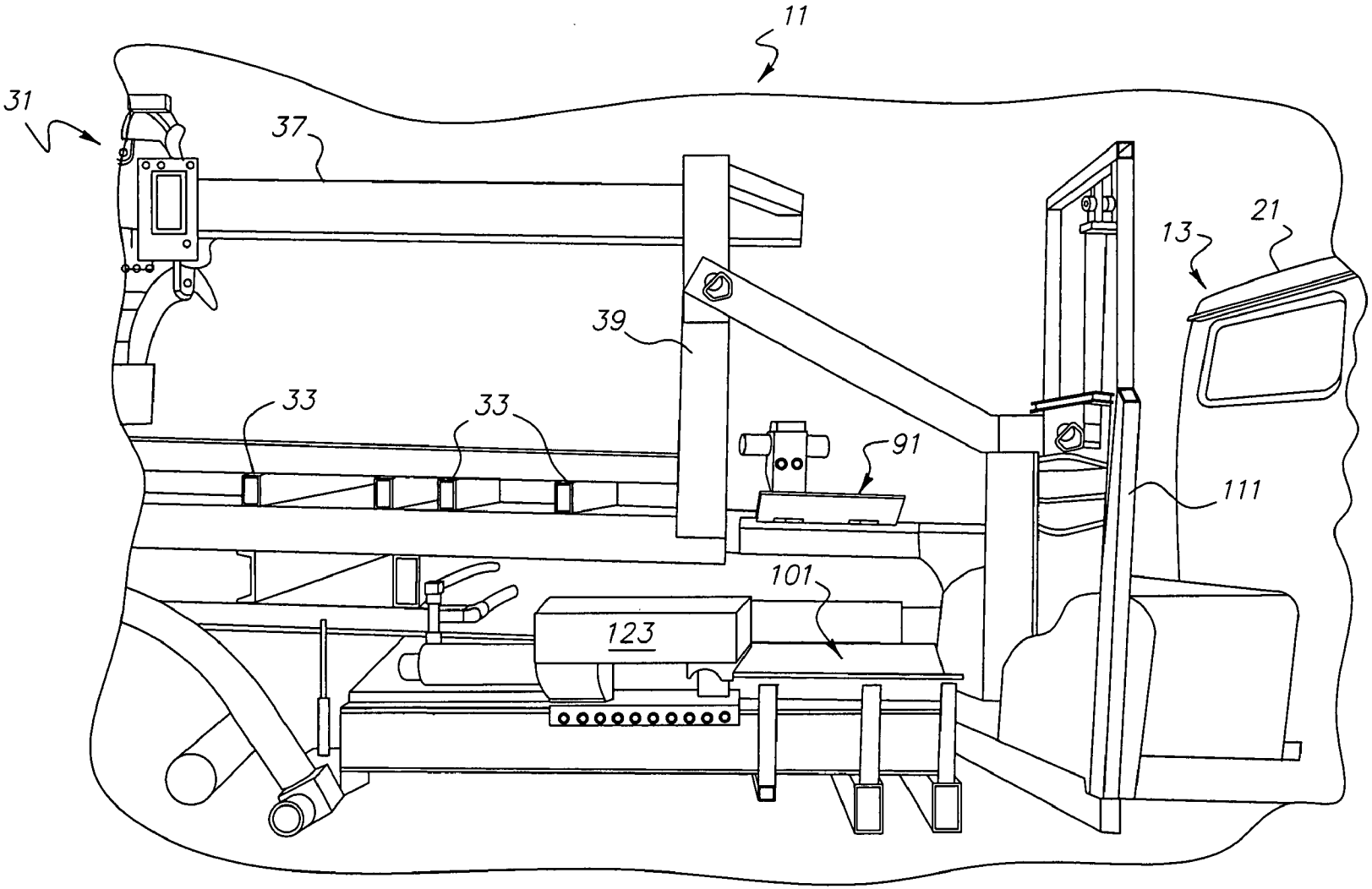
FIG. 3 is a partial side view, in elevation, of the invention as seen from an opposite side thereof from the view of FIG. 1.
Figure 7:
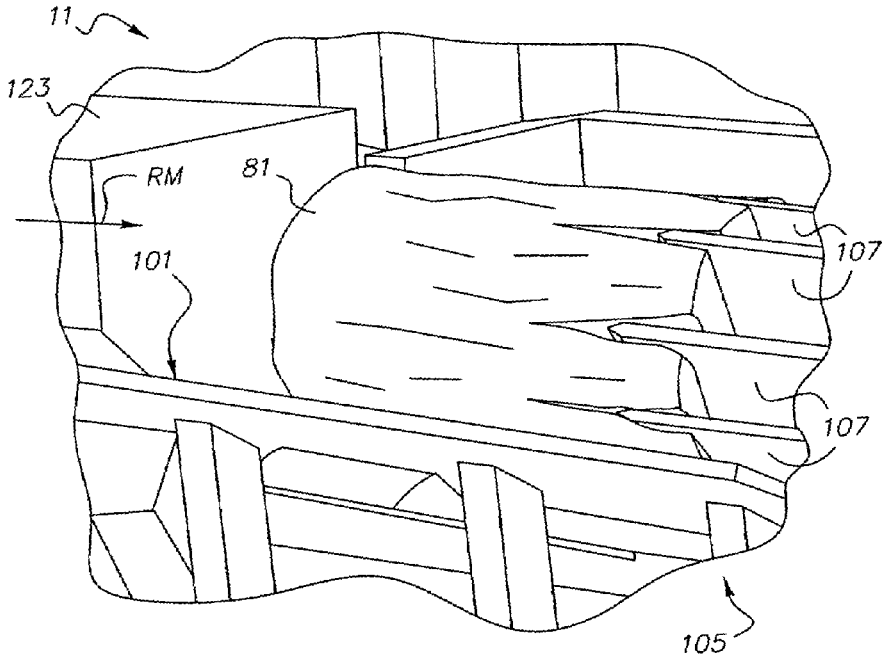
FIG. 7 is a partial side view showing the wood member being split by the splitting device of the invention as the invention's ram member applies force against the wood member.
Figure 8:
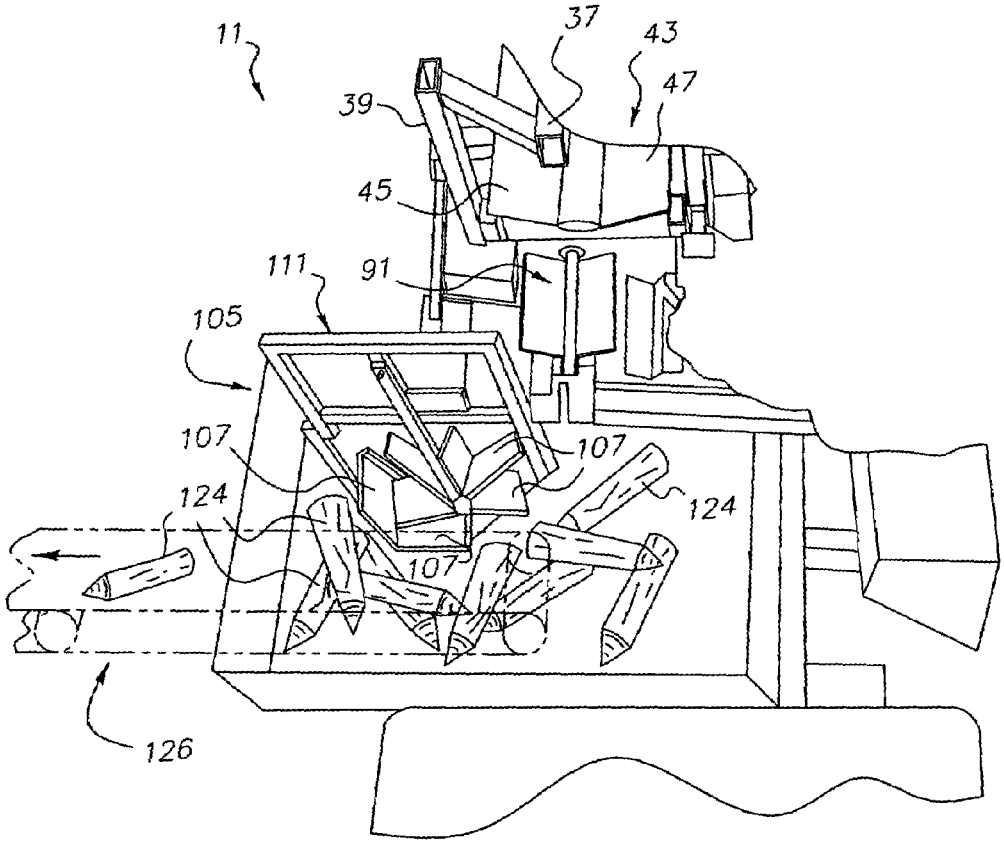
FIG. 8 shows the wood member finally split into at least two pieces and the invention's ram member withdrawn.

As seen in FIGS. 2, 7 and 8, but not shown in FIG. 3 for ease of illustration, apparatus 11 further includes a splitting device 105 which is positioned on the motor vehicle relative to receiving tray 101. In one embodiment, device 105 includes a plurality (e.g., eight) of splitting blades 107 fixedly secured to a frame component 111 which in turn in mounted to the vehicle as shown. In one embodiment, splitting device 105 remains stationary but it is within the scope of the invention to provide it with movement (especially using hydraulics as are used for other components herein) such that it can "retreat" once splitting has occurred, thereby facilitating wood member removal.

Splitting of each cut wood member 81 is accomplished using a ram member 123 located at the end of receiving tray 101 and designed for being actuated (e.g., hydraulically) to engage one end of member 81 and force the member against the blades 107. The apparatus operator triggers this motion upon seeing that member 81 has fallen into the receiving tray and is in the proper orientation for engagement. The ram moves (direction RM in FIG. 7) to force the member 81 to be split into the desired number of pieces 124, representatively shown in FIG. 8. Although eight pieces are cut from member 81, the invention is not limited to this amount because more or fewer pieces can be cut, depending on the number of splitting blades 107 used. In the broadest aspects of the invention, member 81 is split into at least two pieces. Once splitting has occurred and the ram withdrawn to its original position prior to engagement, each of the split wood pieces 124 may simply drop to the ground, or, preferably, onto a conveyor 126 (shown in phantom in FIG. 8), or into a receiving cart (not shown), for further distribution. A conveyor is preferred to quickly move the split wood pieces 124 to a waiting truck or other receiving means (e.g., a cart), where the wood can then be expeditiously removed from the work site, e.g., for distribution, stacking, etc.

As mentioned, many of the components of the invention may be operated by hydraulics. If the case, apparatus 11 may further include a tank 133 positioned below the valve operated control panel 53 (see FIGS. 1 and 2) which includes the requisite amount of hydraulic fluid and to which a suitable pump (not shown) may be attached. Power for the pump may come from the vehicle's drive train (e.g., through suitable mechanical coupling). Such couplings, and other elements (e.g., valves, connecting hoses, pressure gauges) of a hydraulic system as defined herein are known in the art and further description is not considered necessary.

Thus there has been shown and described a wood processor in which various processing functions, especially both cutting and splitting, are capable of being performed in one structure without the need for transport from one structure to another. The invention is operable by a single person who is provided with a relatively safe working environment and who can control the several operations from a single location. The processor as taught herein includes a motor vehicle to allow facile movement of the processor from location to location, while also providing a requisite power source to drive many of the components. The invention may be built using new motor vehicles or many of the components taught herein may be fitted onto existing motor vehicles such as used flat bed trucks.

While there have been shown and described what at present considered the preferred embodiments of the invention, it will be obvious to those skilled in the art that various changes and modifications may be made therein without departing from the scope of the invention as defined by the appended claims. For example, although the invention has been defined in which various components (e.g., the clamping, cutting and splitting devices) are bolted onto the bare frame structure of a truck, it is within the scope of the invention to provide alternative means of coupling these components. For example, selected ones of the components could be mounted on a common frame member which is then coupled onto the truck frame (or even a flatbed), e.g., using pins on the frame to mate with accommodating openings within the truck frame or flatbed. In this way, other common frame members having different components (e.g., a boom adapted for lifting wood logs) could also be coupled to the truck if alternative functions are desired. Still further, it is also possible to use conventional stabilizing devices spacedly positioned about the motor vehicle to stabilize it during processing. This is especially desirable when working in rugged, uneven terrain.

What is claimed is:

1. A wood processor, comprising:

a) a self-propelled motor vehicle including a bed structure adapted to receive a log thereupon, said log being aligned along a major axis thereof;

b) a clamping device depending from and selectively positionable along a horizontal support member positioned above said bed structure and aligned with said major axis for grasping said log and positioning said log along said major axis of said bed structure;

c) a power saw attached to said bed structure and positionable along said major axis for cutting said log to produce a wood member having a predetermined length;

d) a tip pan attached to said bed structure proximate said power saw and selectively movable between a wood member receiving position and a wood member discharging position and adapted to receive said wood member once cut from said log; and e) a splitting device positioned on said motor vehicle for receiving said wood member from said tip pan and splitting said wood member longitudinally into at least two pieces such that said at least two pieces can be removed from said motor vehicle.

2. The wood processor of claim 1 wherein said motor vehicle comprises a truck.

3. The wood processor of claim 1 wherein said clamping device comprises a shuttle grapple assembly comprising at least two hydraulically-driven clamping jaws.

4. The wood processor of claim 1 further comprising:

f) a receiving tray disposed on said motor vehicle relative to said bed structure between said tip pan and said splitting device for receiving said wood member from said tip pan.

5. The wood processor of claim 4 wherein said receiving tray is located at a lower location from said bed structure.

6. The wood processor of claim 4 wherein said tip pan is selectively moved between said wood member receiving position and said wood member discharging position by a hydraulic mechanism operatively connected thereto.

7. The wood processor of claim 4 further comprising:

g) a ram member positioned adjacent said receiving tray for engaging said wood member and moving said wood member across said receiving tray.

8. The wood processor of claim 7 wherein said splitting device is positioned adjacent said receiving tray on an opposite side thereof from said ram member, said ram member forcing said wood member against said splitting device with sufficient force to cause said wood member to be split into said at least two pieces.

9. The wood processor of claim 8 further comprising:

h) a conveyor positioned relative to said receiving tray for receiving said at least two pieces split by said splitting device thereupon and for conveying said at least two pieces away from said wood processor.

10. The wood processor of claim 7 wherein said ram member is hydraulically activated.

11. The wood processor of claim 1, further comprising:

f) a hydraulic system comprising a hydraulic pump.

12. The wood processor of claim 11 wherein said clamping device and said splitting device are hydraulically activated, said wood processor further comprising a control panel positioned on said motor vehicle and operatively coupled to at least said hydraulic system, said clamping device and said splitting device.

13. The wood processor of claim 12 wherein said control panel comprises control valves.

14. The wood processor of claim 11 wherein said hydraulic pump derives motive power from a power take off forming a part of said motor vehicle.

15. The wood processor of claim 13 further comprising:

g) an operator stand located adjacent said control panel and adapted for a human operator positioned thereon such that said human operator can operate at least said control valves of said control panel.

16. The wood processor of claim 15 further comprising:

h) a hydraulic tank including hydraulic oil therein and operatively coupled to said control panel and said hydraulic system, said clamping device and said splitting device for supplying said hydraulic oil to said clamping device and said splitting device in response to operation of said control panel by said human operator.

* * * * *